US006848746B2

(12) United States Patent
Gentry

(10) Patent No.: US 6,848,746 B2
(45) Date of Patent: Feb. 1, 2005

(54) PORTABLE SEAT

(75) Inventor: Todd R. Gentry, Winfield, KS (US)

(73) Assignee: Inno-Labs, LP, Winfield, KS (US)

( * ) Notice: Subject to any disclaimer, the term of this patent is extended or adjusted under 35 U.S.C. 154(b) by 0 days.

(21) Appl. No.: 10/360,047

(22) Filed: Feb. 6, 2003

(65) Prior Publication Data

US 2004/0155506 A1 Aug. 12, 2004

(51) Int. Cl.[7] ..... A47C 7/74

(52) U.S. Cl. ..... 297/380; 297/180.11; 297/188.01; 297/188.04; 297/188.06; 297/188.08; 297/188.12; 297/188.2; 297/228.1; 297/228.11; 297/228.12; 297/229

(58) Field of Search ..... 297/188.01, 188.04, 297/188.06, 188.08, 188.12, 188.2, 228.1, 228.11, 228.12, 229, 380, 180.11

(56) References Cited

U.S. PATENT DOCUMENTS

| | | | | | |
|---|---|---|---|---|---|
| 2,180,426 | A | * | 11/1939 | Milligan | 297/380 |
| 2,702,076 | A | | 2/1955 | Beardsley et al. | 297/252 |
| 2,740,466 | A | * | 4/1956 | Du Priest | 297/188.2 X |
| 2,792,875 | A | | 5/1957 | Pirrone | 297/252 |
| 2,822,968 | A | * | 2/1958 | Jackson | 297/188.06 X |
| 2,865,433 | A | * | 12/1958 | Warner | 297/188.01 |
| 3,120,404 | A | * | 2/1964 | Bramming | 297/188.08 X |
| 3,151,909 | A | * | 10/1964 | Gerdetz | 297/188.2 |
| 3,295,887 | A | * | 1/1967 | Bacon | 297/188.2 |
| 3,298,737 | A | * | 1/1967 | Rosenfeld et al. | 297/188.08 |
| 3,580,633 | A | * | 5/1971 | Du Priest | 297/188.2 X |
| 3,763,972 | A | | 10/1973 | Karzmar | 297/188.2 X |
| 4,573,447 | A | | 3/1986 | Thrash et al. | |
| 4,604,987 | A | | 8/1986 | Keltner | |
| 4,783,120 | A | * | 11/1988 | Kiechlin | 297/188.01 X |
| 4,824,171 | A | * | 4/1989 | Hollingsworth | 297/380 X |
| 4,842,329 | A | * | 6/1989 | Owens | 297/380 X |
| 4,854,637 | A | * | 8/1989 | McCree | 297/188.01 X |
| 4,863,003 | A | * | 9/1989 | Carter | 297/188.01 X |
| 5,120,108 | A | * | 6/1992 | Watson et al. | 297/188.2 |
| 5,190,350 | A | * | 3/1993 | Hwang et al. | 297/380 |
| 5,360,257 | A | * | 11/1994 | Sciacca | 297/380 |
| 5,384,923 | A | * | 1/1995 | Hwang et al. | 297/380 X |
| 5,385,390 | A | | 1/1995 | Freeman et al. | |
| 5,421,637 | A | | 6/1995 | Lemburg | 297/188.01 |
| 5,492,257 | A | * | 2/1996 | Demick | 297/188.04 X |
| 5,516,193 | A | | 5/1996 | Simpson | 297/188.01 X |
| 5,573,288 | A | * | 11/1996 | Raffensperger | 297/188.12 |
| 5,620,227 | A | * | 4/1997 | Brune | 297/380 X |
| 5,639,145 | A | * | 6/1997 | Alderman | 297/188.04 X |
| 5,816,463 | A | | 10/1998 | Echeverri | |
| 5,878,672 | A | * | 3/1999 | Ostermann et al. | 297/188.06 X |
| 5,944,379 | A | | 8/1999 | Yates | 297/230.1 X |
| 6,007,572 | A | * | 12/1999 | Baldwin | 297/380 X |
| 6,079,599 | A | * | 6/2000 | Nordstrom et al. | 297/188.12 X |
| 6,082,816 | A | * | 7/2000 | Gottlieb et al. | 297/188.12 X |
| 6,312,051 | B1 | * | 11/2001 | Adams | 297/228.11 |
| 6,588,840 | B1 | * | 7/2003 | Lombardo | 297/228.12 |

* cited by examiner

*Primary Examiner*—Rodney B. White
(74) *Attorney, Agent, or Firm*—Blackwell Sanders Peper Martin LLP

(57) ABSTRACT

A portable seat is provided. The seat comprises a cushion device inside a pocket formed by an outer casing. A heat transfer device is carried by the cushion device and is inside the outer casing. The cushion may be reversed permitting the heat transfer device to be immediately adjacent the user or to provide at least a portion of the cushion between the heat transfer device and the user.

4 Claims, 6 Drawing Sheets

PORTABLE SEAT

BACKGROUND OF INVENTION

Portable seats, such as stadium seats and collapsible metal frame chairs, are well known. Portable seats typically have fabric components with stadium seats generally comprising an outer fabric casing made of fabric material or the like having an internal pocket for containing a foam cushion member. Some stadium seats have only a base cushion and some further include a back to form a chair with a base or seat portion and a back portion. Generally, a seat with a back and base is foldable along a hinge line between the base and the back and can have fabric straps connecting the two components to keep the back generally at a seat forming position relative to the base and yet still be foldable. The straps may be adjustable to permit selecting the angle of the back relative to the base. The back may also be provided with an internal cushion member. Some seats have rigid stays extending between the front and rear or top and bottom of the side edges to help rigidify the structure against bending of the cushion members. Portable seats have also been provided with an accessory pouch for the storing of such things as drinks, magazines, books, etc. Collapsible metal frame seat have a fabric base and a fabric back which are supported by a series of interconnected and hinged hollow tubes.

Portable seats come in many sizes, shapes and styles. For example they may be foldable to make them more compact for storage and carriage. Some seats have internal cushion members and provide access to the interior for replacement of the cushion member. Portable seats have also been provided with means for providing heat to the user. Examples of these seats are disclosed in U.S. Pat. Nos. 4,604,987 and 4,573,447. Both of these patents disclose that the heater is positioned on the exterior of the seat in an exterior pouch with an opening for facilitating insertion and removal of the heating device. Such heating devices generally require a source of oxygen to effect an exothermic chemical reaction that produces the heat.

While the current seats are effective for their purpose, they do have certain drawbacks. One of the drawbacks for heatable seats is that the source of heat is positioned immediately adjacent to the user which, unless controlled in heat output may cause some discomfort to the user. Such positioning of the heat source can be problematic if the bulk of the produced heat is available for transfer to a user. Further, there is little if any protection for the heater device from environmental elements, for example, a damp or rainy environment. The amount of heat provided to the user is solely controlled by the components utilized to create the exothermic reaction. Additionally, such seats have only been structured for use as a seat limiting their applicability for additional uses.

Thus, there is a need for an improved seat device.

SUMMARY OF INVENTION

The present invention in one embodiment involves the provision of a portable seat comprising a base portion containing which may contain a cushion device adapted for sitting on by a user. The portable seat includes an outer casing defining an internal pocket in which the cushion device is received. A heat transfer device is positioned inside the casing and may be inside a cushion device pocket. The seat base has a top or sitting surface and a bottom or support surface. The heat transfer device may be reversed in position and may be positioned between the cushion and the sitting surface or positioned between the cushion and the support surface. The heat transfer device may also be positioned between two portions of the cushion device. The ability to position the heating device relative to a seat user permits regulation of the amount of heat transfer and hence the temperature to which the user is exposed. The pocket containing the cushion device and heat transfer device is at least partially open to the exterior of the pocket to allow oxygen or other needed component access to the heat transfer device. Control of air ingress into the internal pocket may be used to control operation of the heat transfer device. A back portion may be provided and connected to the base portion to form a chair type configuration. A collapsible frame may also be provided. The seat, with a base and back, may be oriented such that the base and the back lie in a generally common plane to form a mattress. The mattress may be usable under or within a sleeping bag or the like for user reclining while still providing the heat transfer device for comfort purposes. The seat of the present invention may also include a collapsible frame for supporting the base and back portions.

BRIEF DESCRIPTION OF DRAWINGS

Like numbers utilized throughout the various Figures designate like or similar parts.

DETAILED DESCRIPTION

Figure 6:
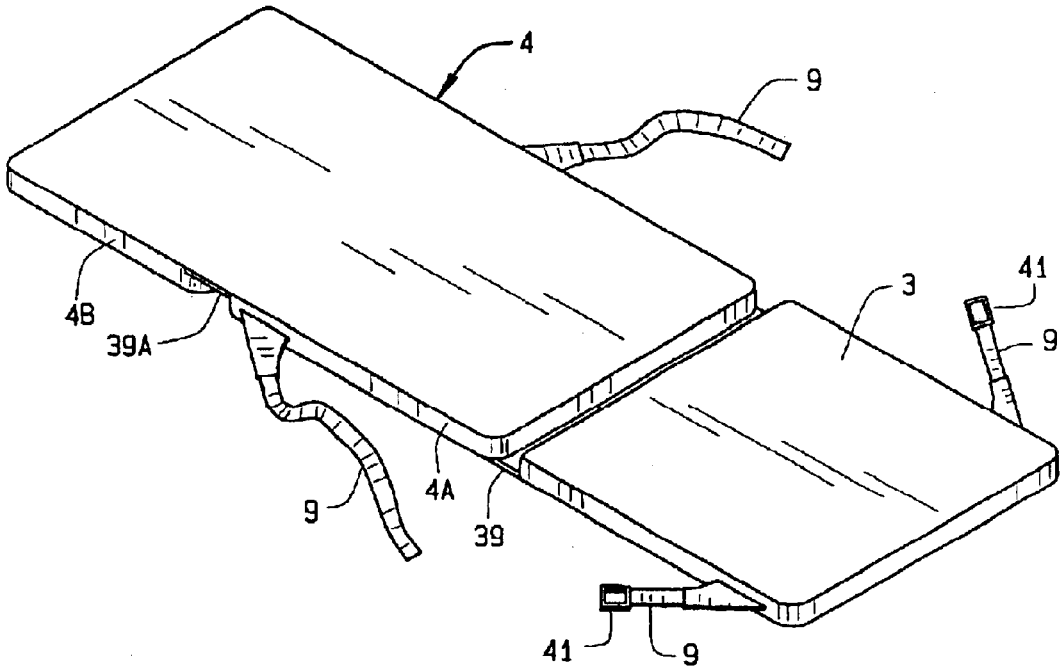
FIG. 6 is a perspective view of a second alternative embodiment of a seat device usable as a mattress and as a seat.

A portable seat is provided and is designated generally as 1. The seat 1, as illustrated includes a base portion 3 and a back portion 4 connected together. The seat 1 has an outer casing 5 enclosing cushion devices 6, 7 in the back 4 and base 3 respectively. Tension members 9 may be connected to and extend between the back 4 and base 3 to selectively fix their orientation relative to one another generally at right angles to form the seat 1. The seat 1 may have the base 3 and back 4 oriented at right angles, folded for carriage or storage, or extended as seen in FIG. 6 to be used by the user in a reclining position as for example as a mattress.

The base 3 includes the casing 5 with top and bottom panels 11, 12, side edges 13, a front edge 14 and rear edge 15. A pocket 17 (FIG. 3) is formed inside the base 3 for receipt of the cushion device 7 therein. An access opening 19 is provided preferably adjacent the rear edge 15 for the installation and removal of the cushion device 7 from the pocket 17. Preferably, the casing 5 is formed of a tight weave fabric such as woven nylon and may have a water repellant or waterproof coating. A closure device 21 (FIG. 2) may be provided at the opening 19 for selectively allowing the opening 19 to be closed or open or partially open. The closure device 21 may be any suitable device such as a hook and loop fastener arrangement or toothed zipper which would allow the ingress and egress of air to and from the pocket 17. The closure 21 may also be of a type that seals or substantially seals the opening 19 such as a rib and groove arrangement or a slide lock as used on plastic bags and the like. An oxygen impermeable fabric in combination with a sealing closure device 21, can be used to seal the pockets 17 from the ingress of oxygen which then can be used to deprive the heat transfer device 23 in the pocket 17 of a reaction required component such as oxygen, thereby stopping an oxidative chemical reaction which may be exothermic or endothermic and preferably exothermic.

Figure 3:
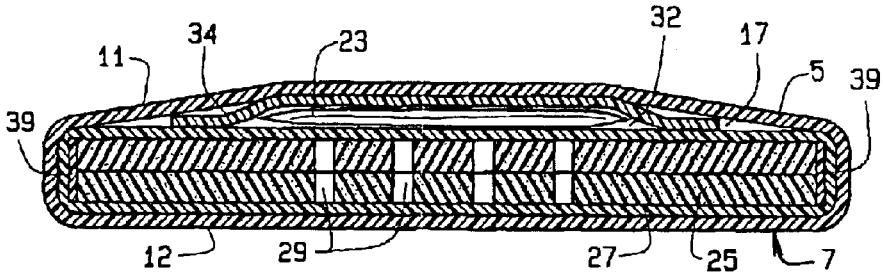
FIG. 3 is a cross sectional view of a cushion device with attached heat transfer device taken along the line 3—3, FIG. 1.
Figure 4:
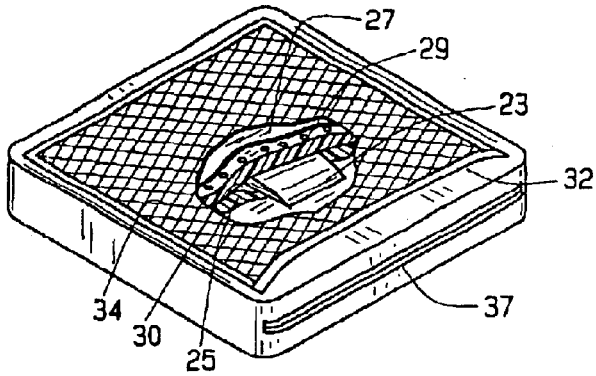
FIG. 4 is a perspective view of a modified form of cushion device with sections broken away to show internal details.

The cushion device 7 preferably includes a cushion member 25 (FIGS. 3, 4) encased within a cover 27 which may be of any suitable material such as woven, knit or other suitable fabric. The cushion member 25 may be of a foam polymeric material and can be open cell or closed cell as is desired for the particular application. The cushion member 25 may be provided with holes 29 extending from an outer surface to at least an interior portion of the cushion member or through the cushion member as best seen in FIGS. 3, 4. The cushion member 25 may include an internal receptacle 30 accessible from the exterior of the cushion member (FIG. 4). Such a receptacle 30 may be formed by cutting a single piece of cushion member from one side to form the receptacle 30. The receptacle 30 may also be formed by laminating two pieces of cushion material together with a receptacle therebetween formed by unsecured portions of the cushion material or by having two layers of cushion material positioned in superposed relationship (FIG. 3) allowing the heat transfer device 23 to be positioned between the two portions of the cushion member 25 (FIG. 4). The holes 29 preferably communicate with the receptacle 30 for the ingress of air, and in particular oxygen, and can be also constructed to control the rate of heat transfer from or to the heat transfer device 23 and thus to the user of the seat 1 by the reduction of a predetermined amount of insulating material in the cushion member 25.

Figure 2:
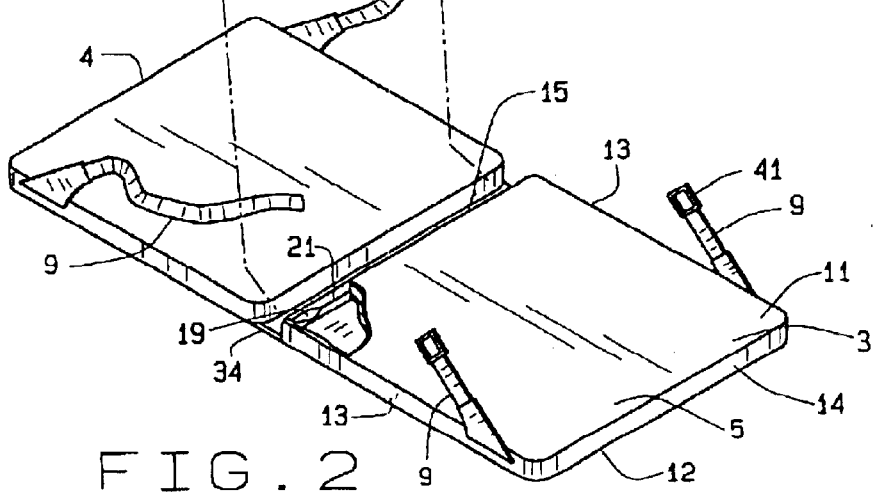
FIG. 2 is an exploded view of the seat device of FIG. 1.

The cushion device 7 includes the cover 27. As shown, the cover 27 in one form of the invention, as seen in FIGS. 2, 3, has an external pocket 32. The pocket 32 may be formed by attaching a member 34 of open weave or porous material which is readily permeable to the flow of oxygen and other gases to the heat transfer device 23. One side of the pocket 32 is left open for the insertion and removal of the heat transfer device 23 from a position between the pocket forming member 34 and the cover 27. Suitable open mesh materials can be woven or knit and may have a significant number of pores of approximately 1/32 inch across or larger for example up to about 1/4 inch although larger openings may be used. In the form of the invention shown where the heat transfer device 23 is positioned between portions of the cushion member 25 as seen in FIG. 4, the cover 27 has an access opening 37 formed along one side to provide access to the pocket 17 for insertion and removal of the heat transfer device.

The cushion device 7 may be positioned in one of a plurality of orientations within the pocket 17. For example, the heat transfer device 23 is contained within the pocket 17 inside of the casing 5 and may be positioned at the user engaging panel 11 for higher heat transfer at higher temperature or can be positioned adjacent the bottom panel 12 for reducing heat transfer rate to or from the user. Additionally, the heat transfer device 23 may be positioned in the receptacle 30 between portions of the cushion member 25 to provide further control of the rate of heat transfer to or from the user.

An optional feature of the present invention is the use of stays 40 positioned adjacent to side edges of the cushion member 25 to provide front to rear rigidity. The stays may be formed from a suitable resiliently deformable but relatively rigid material for example nylon or metal bars. The stays 40 may be secured to the cushion member 25, the cover 27 or retained in pockets (not shown).

Figure 1:
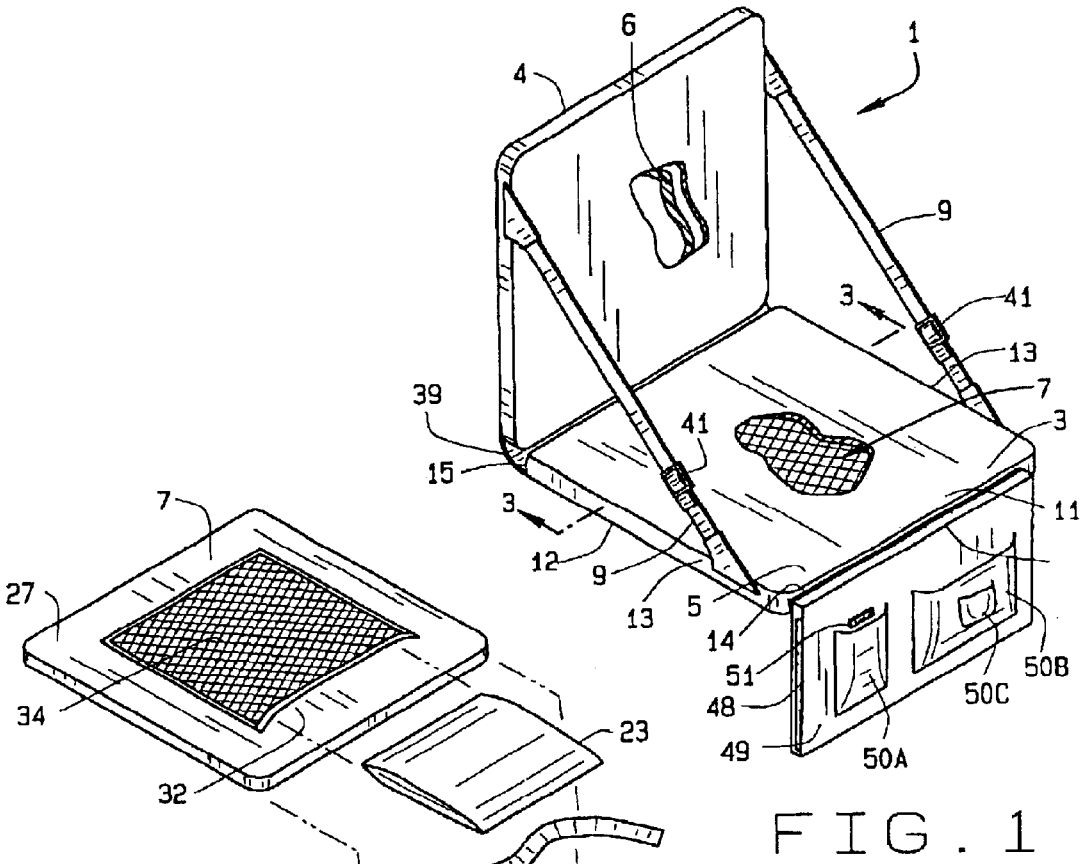
FIG. 1 is a perspective view of a portable seat device.

The base or seat portion 3 of the seat 1 is preferably attached to the back portion 4. This can be done by simply using a portion 39 of the casing 5 as a hinge between the seat and back portions. Such a hinge arrangement provides an integral or monolithic structure allowing the base 3 and back 4 and the cushion devices 6, 7 to remain together and to be folded in overlying relation to form a compact structure for storage or carrying, or to be positioned at substantially 90° together to form a seat with a base and back. Further, by releasing the tension members 9, for example, at a quick disconnect buckle 41. The base 3 and back 4 may be positioned in substantially the same plane to form a mattress or the like (FIG. 6). As seen in FIG. 6, the seat 1 has three sections, the base 3 and the back 4 in two sections denoted 4A and 4B. The sections 4A, 4B are connected by a hinge portion 39A like the portion 39. The seat 1 may be used as a freestanding mattress or in or under a sleeping bag. An additional configuration allows the user to position the base 3 on the back 4 to provide a double thickness sitting pad. Either base 3 or back 4 may be comprised of two hingedly connected portions to form a three section seat 1 as opposed to a two section device as seen in FIGS. 6 and 1 respectively. A heat transfer 23 device may be utilized in both the base and the back (which can then be of similar construction) however, in the embodiment shown, only one heat transfer device is used.

The back 4 may also be provided with rigidifying stays (not shown) similar to the stays 40.

As seen in FIG. 1, the seat 1 includes an accessory pack 49. The pack 49 may be permanently attached to the seat 1 or removably attached as with a fastener mechanism 48 such as hook and loop fasteners, a zipper, buttons, or other fastener devices as are well known in the art. The pack 49 includes a plurality of storage pockets 50 denoted 50A, 50B, 50C for distinction. The pockets 50 may be sized and shaped for any suitable product or item to be placed therein, for example, drink containers, magazines, lights, clothing articles, shoes, etc. The pockets 50 may be provided with closures 51 such as hook and loop fasteners to provide some level of security against the loss of contents from the pockets 50.

Figure 5:
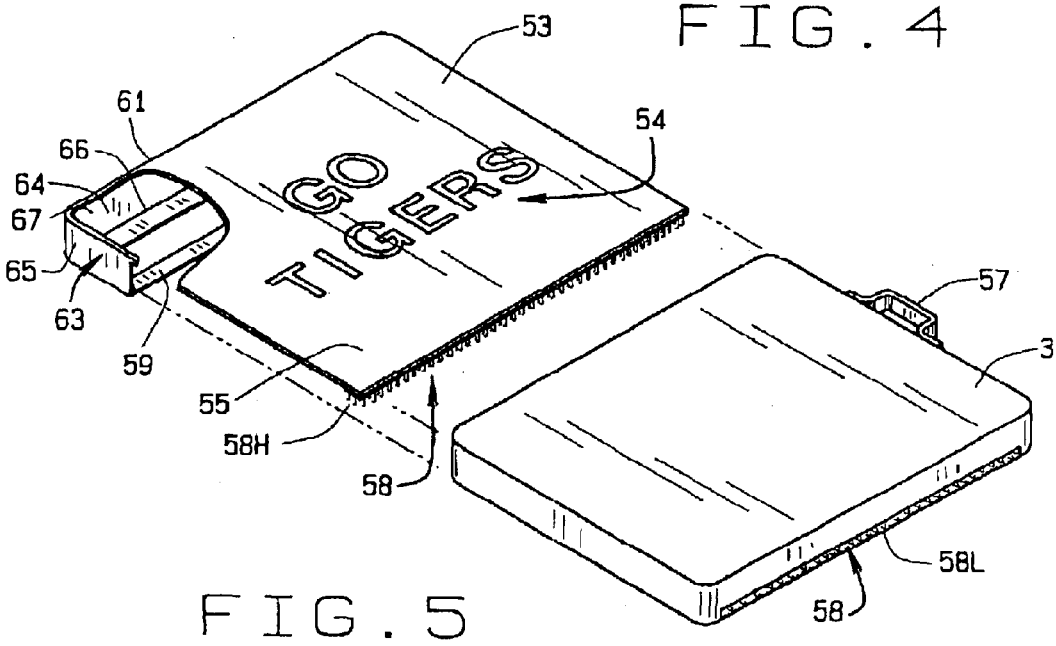
FIG. 5 is an exploded perspective view of an alternative embodiment of the seat showing a removable panel with expository indicia thereon.

As seen in FIG. 5, a display panel 53 is provided. The panel 53 includes a main display face 55. Expository indicia 54 such as a team name or logo, a town name, a person's name, etc. may be provided on the face 55. The panel 53 is preferably removably attached to a base 3 or back 4 and may be used with a base 3 without a back 4. In the illustrated structure, the display panel 53 is secured to a base 3 with a hook and loop fastener device 58 including a hook strip portion 58H and a loop strip portion 58L positioned adjacent one edge of the base 4 and may also be provided with an elastic strap 59 secured to and extending between portions of opposite sides of the panel 53 to have a central portion of the panel tensioned to prevent distortion of the panel and the indicia 54 thereon. The edge 61 of the display panel 53 opposite the edge where the hook and loop fasteners 58 may also be provided with a suitable coupler 63 securing that edge of the display panel 53 also to a base 4. As shown, the coupler 63 is in the form of a base or back receiving pocket 64 formed by side, bottom and end panels 65, 66, 67 respectively. Such a construction allows the manufacture of seats and/or backs in bulk which can then be customized easily by the addition of a separate display panel 53. It is to be understood that even though the display panel 53 is shown as releasably attached, permanent attachment may be provided as for example with adhesive, stitching or the like.

In operation of the seat 1, a user may transport the seat to a place of use. The seat 1 may include only a base 3 or may comprise a back 4 connected to a base 3. A carry handle 57 (FIG. 5) may also be provided. To use a heat transfer device 23, the cushion device 7 is removed from the base 3 and a heat transfer device is installed as described above. The heat transfer device 23 may be any suitable form to provide an endothermic or exothermic chemical reaction to produce heat or to extract heat. The heat transfer device 23 may also be a preheated or pre-cooled heat transfer device as are well known in the art. After installation and activation, if needed, of a heat transfer device 23, the cushion device 3 may be reinstalled in the base in the desired orientation, i.e., the heat transfer device 23 is adjacent to the top face 11 or adjacent to the bottom face 12 or between portions of the cushion member 25. The user may then use the seat 1 by sitting or reclining (in the event the seat 1 is laid out for use to recline on) thereon. If the heat transfer device 23 becomes exhausted or spent, the spent heat transfer device may be removed and a new heat transfer device inserted at the appropriate location. If the heat transfer device 23 is of a type that utilizes a chemical reaction and the chemicals are not yet spent when current use is completed, the heat transfer device may be easily removed from the base 3 and placed in a sealed plastic container or the like to deprive it of an essential component to effect the chemical reaction, for example, oxygen. Without the essential element, the heat transfer device 23 will soon cease to operate by the stopping of the reaction. The heat transfer device 23 may then be reactivated by removing it from the sealed container and inserting into the seat 1 for continued use. It is to be noted that the casing 5 for the base 3 may be structured to be relatively oxygen impermeable to the degree, when sealed, to cause cessation of the chemical reaction of the heat transfer device 23. This can be accomplished by coating the fabric of the casing 5, in the event it is a fabric casing, and sealing the opening 19 as for example with a rib and groove or slide lock closure member to selectively prevent the ingress of oxygen into the pocket 17.

Figure 7:
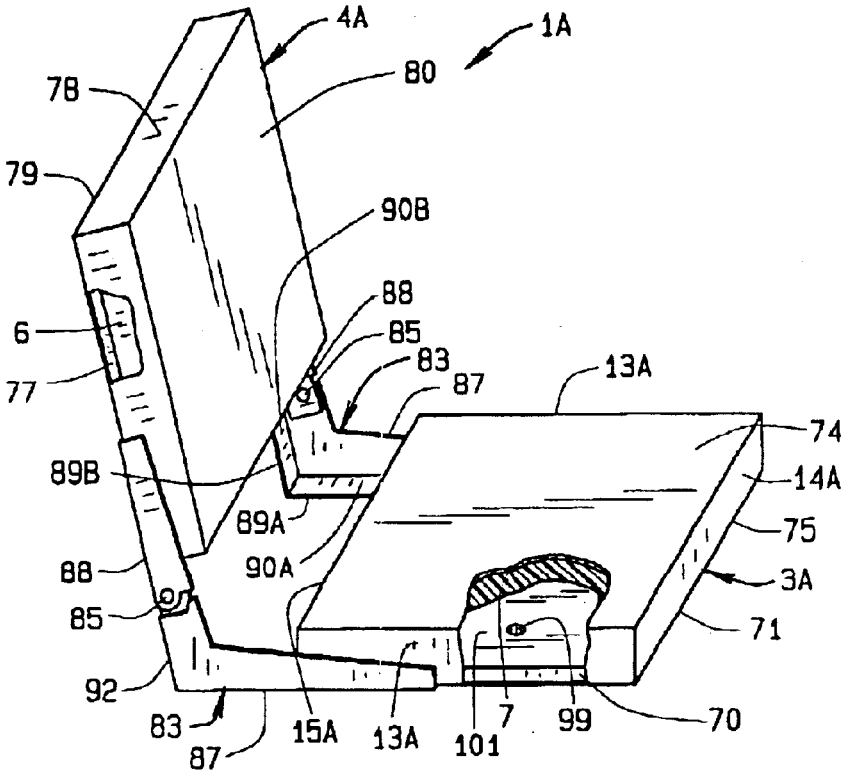
FIG. 7 is a perspective view of another alternative embodiment of the present invention utilizing auxiliary hinges to connect the seat and back portions of the portable seat.
Figure 8:
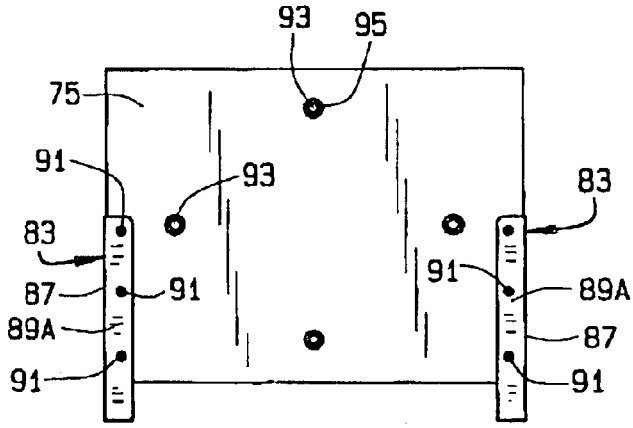
FIG. 8 is a bottom plan view of the portable seat of FIG. 7 showing the underside of the base portion of the seat.

FIGS. 7, 8 illustrate an alternative embodiment of the present invention. The seat 1A comprises a base 3A and back 4A similar in the construction to the base 3 and back 4 described above and need not be further described herein. However, as seen in FIG. 7, the base 3A includes a generally rigid support 70 contained within a casing 71 that is similar to the casing 5 for the base 3. The base 3A has a cushion device 7 as described above. The support member 70 preferably extends between the side edges 13A and the front and rear edge 14A, 15A, respectively, of the base 3A and is generally parallel to the top face 74 and the bottom face 75. The material of the casing 71 is similar to that described for the outer casing 5. The back portion 4A is similar in construction to the back 4 described above and has a cushion device 6 therein. It also includes a substantially rigid member 77 like the support 70 which is positioned inside the casing 78 which is similar to the casing 5 described above. The support member 77 is generally parallel to the back and front faces 79, 80. The supports 70, 77 are resiliently deformable and may be plywood, particle board, molded plastic, etc.

The base 3A is hingedly connected to back 4A. In the illustrated structure, a pair of hinge members 83 is provided to hingedly connect the base 3A to the back 4A. As shown, each hinge 83 includes a hinge pin 85 connecting together two hinge arms 87, 88. Flanges 89A, 89B are provided on both the arms 87, 88 to form a generally L-shaped portion of each arm providing two faces 90A, 90B for engagement with the base 3A and back 4B respectively. Fasteners 91, such as screws, are used to secure the arm 87, 88 to the base 3 and back 4. The fasteners 91 pass through the casing 71, 78 and into the respective support member 70, 77. The arms 87 have legs 92 which receive a hinge pin 85 therethrough and have length sufficient to allow the base 3A and back 4A to overlie one another in generally parallel orientation when the set 1A is collapsed.

As seen in FIG. 8, the casing 71 is provided with a plurality of apertures 93 on the bottom surface 75. The apertures 93 may be formed by grommets 95 secured to the fabric of the casing 71. The grommets 95 have the apertures 93 therethrough. The apertures 93 register with and are in alignment with respective apertures 99 in the member 70. Aligned apertures 93, 99 permits the flow of air into and out of the interior 101 of the casing 71 allowing air to flow to a heat transfer device (not shown) similar to the heat transfer device 23.

Figure 9:
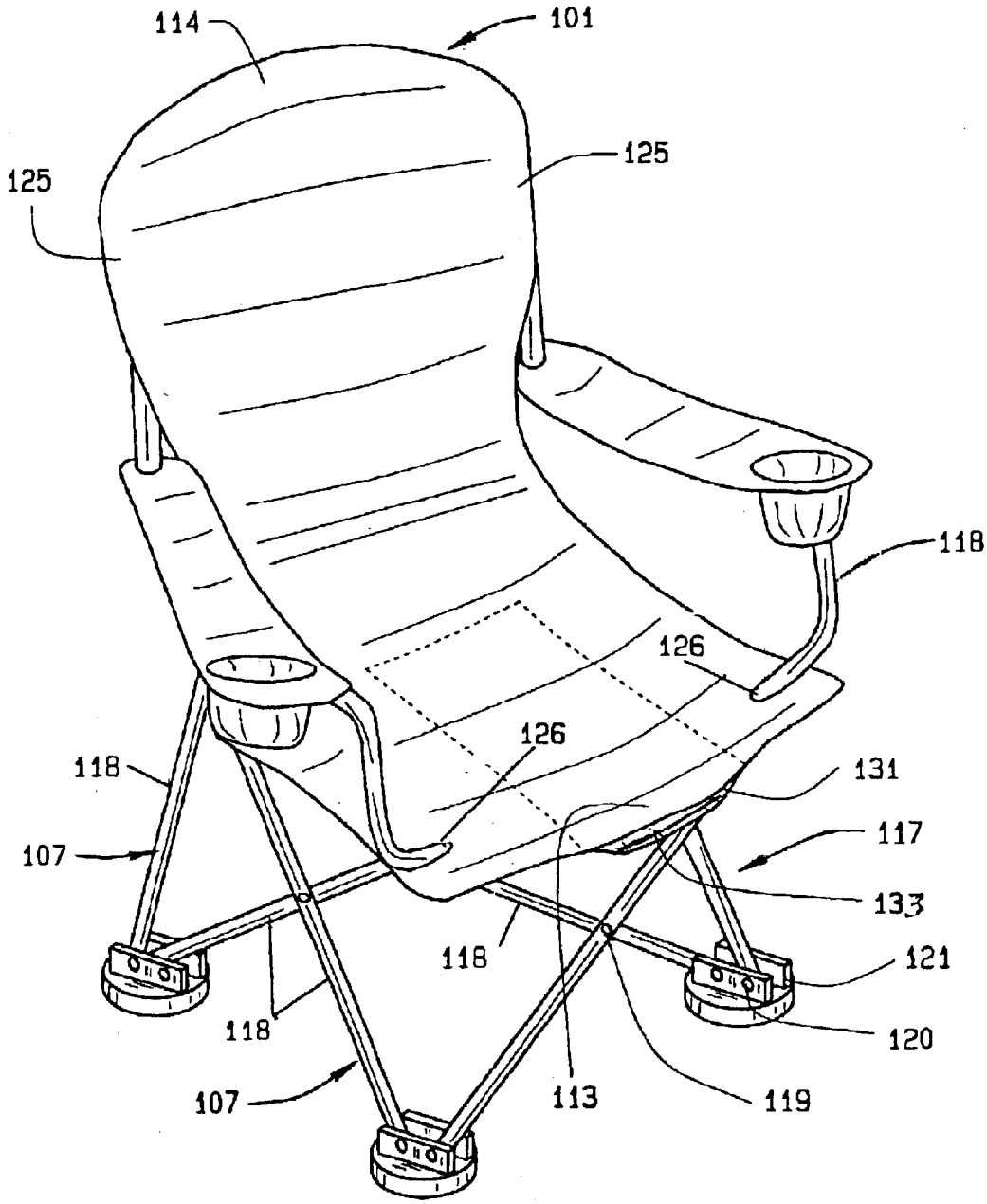
FIG. 9 is a perspective view of a collapsible frame seat with portions broken away to show structural details of the seat.
Figure 10:
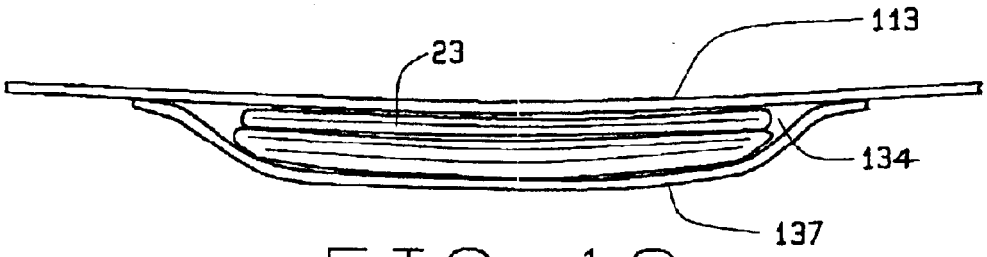
FIG. 10 is an enlarged fragmentary end view of a base portion of the seat of FIG. 9.
Figure 11:
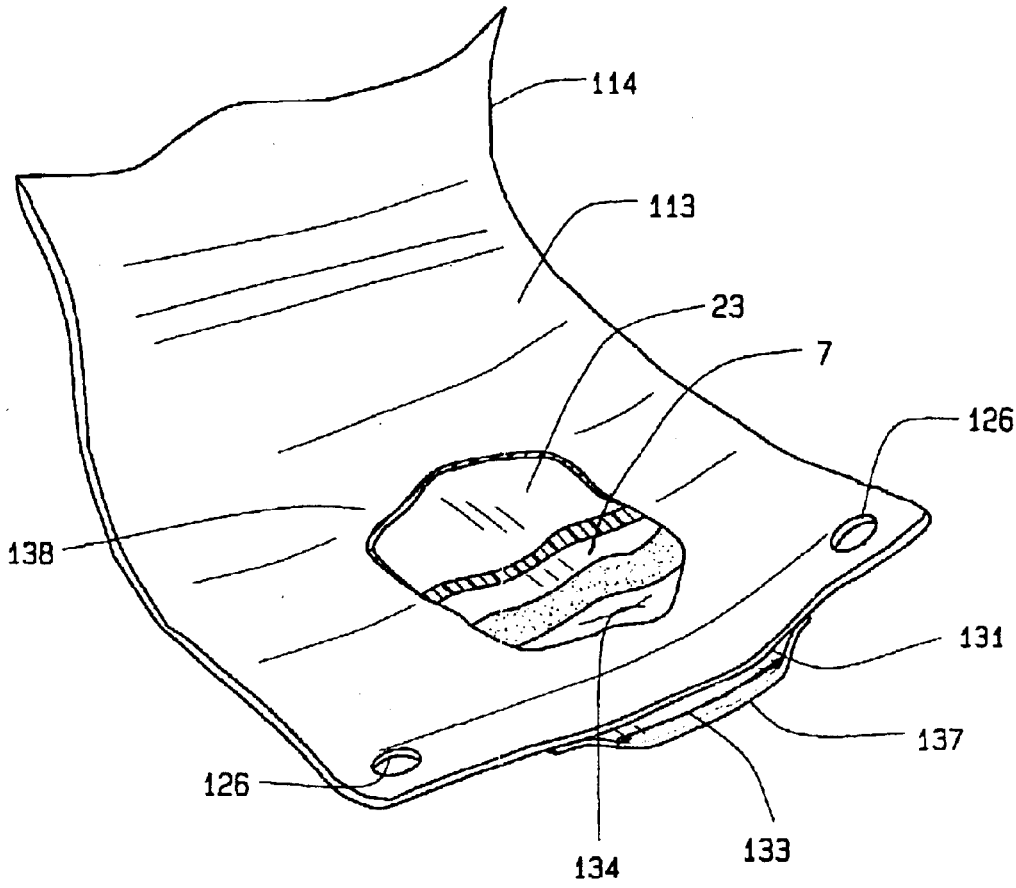
FIG. 11 is an enlarged fragmentary view of portions of the seat shown in FIG. 9 to better show internal details of the base portion.

FIGS. 9, 10 and 11 show another embodiment of the present invention. This embodiment is in the form of a portable seat 101 with front and rear legs denoted generally 107 to support the base 113 and the back 114. The legs 107 are part of a collapsible metal frame designated generally 117. The collapsible frame 117 is preferably formed of round tubular members designated generally 118 hingedly connected as at 119 where frame portions cross and at 120 at the feet 121 to permit the frame to be collapsed for storage and carriage. The hinged frame 117 permits selective hinged movement between the base 113 and back 114 between open and closed conditions. The base 113 is suitably connected to the frame 117 as by having portions of the frame extend through eyelets 126 sewn or otherwise formed in the fabric of the base 113. The back 114 is suitable connected to the frame 117 as by having portions of the frame received within channels at 125 sewn or otherwise formed in the fabric of the back 114. The back 114 can be similar in construction to the back 4 with the addition of the channels 125 formed on the sides thereof. The back 114 may or may not contain a cushion device 6 as described above. If a cushion device is not provided then the back 114 may be a single layer of fabric with sewn in channels 125 for attachment to the frame 117. As shown, the base 113 and back 114 are connected as by sharing a common fabric piece like the seat 1.

The base 113 can be similar to the base 3 described above and can be made by having eyelets 126 attaching the base 113 to the frame 117. As shown, the base 113 includes a selectively openable front edge 131 which provides an elongate opening 133 providing access to an interior pocket 134. In order to assist in the use of seat 101, it is preferred that the cushion device 7 be of a very flexible material such as the foam described above or a polymeric fiberfill material such as polyester fibers to help provide cushioning and insulation. In this embodiment, the cushion device 7 would be generally constructed as described above including the pocket for the heat transfer device 23 and a pocket for foam or just described fiberfill. In an alternate construction, the pocket 134 in the base 113 may contain a heat transfer device 23 without the use of a cushion device 7. The means to selectively close and/or seal the opening 133 of the base 113 may be such as to limit or control the ingress and egress of air into and out of the pocket 134. The base 113 may also be provided with grommets like the grommets 95 described above in the lower panel 137. A heat transfer device 23 is retained within the pocket 134 between an upper panel 138 and the lower panel 137 and is retained therein by closing the opening 133 through the use of suitable closures such as hook and loop fasteners, a toothed zipper or a rib and groove arrangement as described above for the base 3.

Thus, there has been shown and described several embodiments of a portable seat. As is evident from the foregoing description, certain aspects of the present invention are not limited by the particular details of the examples illustrated herein and it is therefore contemplated that other modifications and applications, or equivalents thereof, will occur to those skilled in the art. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A portable seat comprising:

a bottom portion including:

an exterior casing forming an interior pocket and having an elongate opening providing access to the pocket;

a cushion member contained within the pocket;

a cover in the interior pocket and at least partly surrounding the cushion member and selectively removable therewith from the interior pocket and adapted to removably retain a heat transfer device adjacent to the cushion member and in heat transfer relation to an exterior surface of the exterior casing, said cover at least partly defining a receptacle adapted to contain a heat transfer device therein and positioned between an exterior portion of the cover and an open weave member secured to and overlying a portion of the cover on a major face thereof with the receptacle being between the cover and the member, where said receptacle is reversible in position whereby the receptacle is selectively position at a location adjacent to the sitting surface or remote from the sitting surface with a portion of the cushion member between the heat transfer device and the sitting surface;

a second opening providing access to the receptacle for installation and removal of a heat transfer device; and a back support portion connected to the bottom portion and the bottom portion has a sitting surface.

2. A seat as forth in claim 1 wherein the bottom portion and back support portion each include a resiliently deformable generally rigid member therein and said back support portion is connected to said bottom portion by a hinge mounted on each side of the seat and secured to said rigid members.

3. A cushion device selectively usable as a seat, the cushion device including:

a seat portion having an exterior first casing with a first receptacle therein;

a back portion having a second exterior casing with a second receptacle therein;

a cushion member in each of the first and second receptacles;

an opening providing access to at least one of the first and second receptacles;

a retainer device in one of said first and second receptacles adapted to receive a heat transfer device far selectively retention therein;

at least one member connected to the seat and back portions to selectively retain the seat and back portions in a chair forming orientation and selectively allowing the seat and back portions to lie in a generally common plane to form a mattress; and an extension portion comprising a third exterior casing with a third receptacle therein and a cushion member in the third receptacle, said extension portion being selectively movable to lie in said generally common plane.

4. A device as set forth in claim 3 wherein there is a said retainer device in each of at least two of said seat portion, back portion and said extension portion and a plurality of heat transfer devices each selectively positionable in a respective one of said seat, back and extension portions to provide a plurality of heat transfer zones.

* * * * *